US006308026B1

(12) United States Patent
Kouchi

(10) Patent No.: US 6,308,026 B1
(45) Date of Patent: Oct. 23, 2001

(54) IMAGING FORMING APPARATUS USING INDEPENDENT MODULES

(75) Inventor: Kazuhiro Kouchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/580,600

(22) Filed: May 30, 2000

(30) Foreign Application Priority Data

Aug. 4, 1999 (JP) ..... 11-220915

(51) Int. Cl.[7] ..... G03G 15/00
(52) U.S. Cl. ..... 399/110; 399/90; 399/92
(58) Field of Search ..... 399/110, 393, 399/403, 405, 407, 408, 409, 410, 107, 90, 92

(56) References Cited

U.S. PATENT DOCUMENTS 5,655,208 * 8/1997 Sahay et al. ..... 399/397
5,710,635 * 1/1998 Webster et al. ..... 358/296
5,819,137 * 10/1998 Hoffman et al. ..... 399/93
5,875,383 * 2/1999 Stemmle ..... 399/384
5,918,089 * 6/1999 Malinich et al. ..... 399/90
5,920,759 * 7/1999 Ushiroji et al. ..... 399/406

FOREIGN PATENT DOCUMENTS

A-6-276334 9/1994 (JP) .

* cited by examiner

*Primary Examiner*—Robert Beatty
(74) *Attorney, Agent, or Firm*—Oliff & Berridge, P.L.C.

(57) ABSTRACT

There is provided an image forming apparatus in which handling at the time of transportation or movement is convenient, noise, sheet clogging, generation of an electromagnetic noise, and the like can be effectively suppressed, and the operationality of maintenance operations, part exchanging operations, removing operations of clogged sheet, and the like is excellent. The image forming apparatus is constructed by basic modules of independent structures of an image output module, a sheet supply module, and a sheet discharge module. The sheet supply module is connected and disposed at one of right and left sides of the image output module, the sheet discharge module is connected and disposed at the other side, and the modules are used in an integrated state. In addition, an electrical-related module is connected and disposed at the rear side of the sheet supply module, and an environment conservation module is connected and disposed at the rear side of the image output module.

14 Claims, 12 Drawing Sheets

IMAGING FORMING APPARATUS USING INDEPENDENT MODULES

BACKGROUND OF THE INVENTION

1. Field of the Invention

The present invention relates to an image forming apparatus using an electrophotographic system, such as a copying machine, a printer, or an integrated machine of them, and particularly to an image forming apparatus constructed by plural modules made of independent structures in which the whole of the apparatus is very effectively divided into parts.

2. Description of the Related Art

In recent years, in a color copying machine or printer, except for a personal type in which importance is given to miniaturization, the size and weight of the whole apparatus tends to become large by the increase of basic structural parts accompanying color image formation and the increase of parts accompanying diversification of functions.

In general, such a copying machine or printer is often constructed such that an image forming portion for forming a toner image corresponding to image information, transferring it to a recording sheet, and then fixing it, a sheet supply portion for accommodating the recording sheet and transporting it to the image forming portion, and a sheet discharge portion for discharging the recording sheet after being fixed in the image forming portion to the outside are housed in one casing and are unified. Further, in the case of the copying machine, a document reading portion f or reading an image of a document is housed in the casing and a unified structure is made.

However, in the image forming apparatus, such as the copying machine or printer, in which the image forming portion, the sheet supply portion, and the discharge portion, and further, the document reading portion are housed in one casing and are unified like this, there are technical problems as described below.

First, there is a problem that since the image forming apparatus is made of one large casing, its packaging becomes large and the weight becomes heavy so that handling is difficult. Further, if a narrow place, such as an elevator or an entrance of a room, exists when the apparatus is transported for delivery or is moved to change the installation place, to pass through the place is difficult, and according to circumstances, it is impossible to transport or move it. Thus, there is a problem that the operations of transportation and movement are often inconvenient.

Besides, since all the structural parts generating operation sounds, such as driving parts or sheet conveying passages, are housed in one casing, the respective operation sounds are resonated to be amplified or become apt to leak out of the apparatus. Thus, there is a problem that a large noise is made at the time of image formation.

Besides, since all of the respective structural parts are housed in one casing, the conveying passage of the recording sheet often comes to have a complicated or abruptly bent structure such as an S-shaped or U-shaped structure. Thus, there is a problem that paper clogging or conveying sound becomes apt to be made, or it is difficult to remove the clogged paper. Since other structural parts are also provided in a state where they are close to each other, there is a problem that maintenance operations or exchange operations are hard to perform.

Moreover, although the number of recording sheets used becomes large as the speed of an image forming process is increased, it is difficult to enlarge the sheet supply portion already existing in the casing such that a large amount of recording sheets can be accommodated, and in the case where a large capacity tray or the like is added through later attachment to the apparatus body to meet the request, the apparatus installation space is increased. Thus, there is a problem that a suitable measure can not be made eventually.

Besides, since the mutual parts are provided in a state where they are close to each other in the casing, there is a possibility that an electromagnetic wave emitted from an electronic equipment such as a control circuit substrate adversely influences other parts, and further, there is a fear that lowering in picture quality is induced. Besides, there is also a fear that the electromagnetic wave induces an erroneous operation or the like of another electronic equipment existing at the periphery of the apparatus.

Incidentally, also in the prior art, there is proposed a copying system provided with a scanner module including a unit to read an image of a document, a printer module including a unit to form image data as an eternal visual image on a recording medium and output it, and a system control module including a unit to control the scanner module and the printer module such that they are operated in synchronization (Japanese Patent Unexamined Publication No. Hei. 6-276334).

However, in this copying system, in the case where the three basic modules and a table (or a selection multi-stage paper feeding device) are combined, since it is designed such that those are preferably vertically combined (see a disclosure in paragraph 0024, FIG. 20, etc.), there is a problem that a size increase in height direction can not be avoided. Besides, since the print module, including a one-stage paper feeding device, is provided with a function up to a step of discharging a recording sheet after fixing to the outside of the apparatus (see FIG. 8, etc.), it is apt to become large. Besides, since many structural parts are provided in one casing in a close state, there is a problem that maintenance and exchange operations of each structural part are hard to perform. Further, in the print module, since a driving system or a sheet conveying passage which becomes a generating source of operation sound is also housed in one casing, there is also a problem of noise as described before.

SUMMARY OF THE INVENTION

The present invention provides an image forming apparatus which can solve the foregoing problems.

An image forming apparatus of the invention includes an image output module made of an independent structure provided with at least an image forming and transferring unit to form a toner image corresponding to image information and to transfer it to a recording sheet, a fixing unit to fix the toner image transferred to the recording sheet by the image forming and transferring unit, and a sheet conveying passage to convey the recording sheet to cause it to pass through the image forming and transferring unit and the fixing unit; a sheet supply module made of an independent structure provided with at least a sheet accommodation unit to accommodate the recording sheet supplied to the image output module, and a sheet sending passage to send out the recording sheet accommodated in the sheet accommodation unit to the image output module; and a sheet discharge module made of an independent structure provided with at least a sheet discharge passage to convey the recording sheet after having passed through the fixing unit of the image output module and to discharge it to the outside of the apparatus, the sheet supply module is connected and disposed at one of both sides of the image output module, the sheet discharge module is connected and disposed at the other, and the modules are used in an integrated state.

According to this image forming apparatus, the sheet supply module is separated from the image output module, and further, the sheet discharge module is also separated, so that the image output module becomes very compact. Especially, the independent structure of the sheet discharge module is adopted, the freedom of setting of position of a sheet discharge port is widened. Besides, since an independent space can be secured, it is possible to easily provide a mechanism to cancel curl generated in the recording sheet after fixing, or to provide part of structural parts which are hitherto provided at the side of the image output module. Moreover, since driving parts and sheet conveying routes can be dispersedly provided in the sheet supply module, the image output module, and the sheet discharge module, it becomes possible to disperse noise generating sources. Moreover, since the sheet conveying routes can be provided dispersedly to the respective three modules as described above, the number of complicatedly bent conveying routes can be decreased. In addition, since the sheet supply module is the independent structure, even in the case where the image forming apparatus becomes a high speed machine, it is possible to easily realize a sheet supply portion capable of accommodating and supplying a large number of recording sheets.

Besides, it is preferable that this image forming apparatus is constructed such that in addition to the three basic modules, an electrical-related module made of an independent structure provided with at least a power supply part and an electronic equipment is connected and disposed at a rear side of the sheet supply module, and an environment conservation module made of an independent structure provided with at least a suction-collection unit to suck and collect an unnecessary substance produced in the apparatus is connected and disposed at a rear side of the image output module.

In the case where such electrical-related module and environment conservation module are added, in the electrical-related module, it is possible to restrain an electromagnetic wave generated from the power supply part, electronic equipment, or the like from exerting an influence on other parts (including a bad influence on a peripheral electronic equipment). Besides, in the environment conservation module, a driving part for suction operation of the suction-collection unit can be provided in a dispersed state where it is separated from the image output module, and the operations of inspection or recovery of a part (filter, etc.) for collecting the unnecessary substance (ozone, dust, etc.) can be performed in a concentrated state. The electrical-related module in which the number of steps of wiring operations is large at the time of connection or separation between the modules is provided at the rear side of the sheet supply module in which access is relatively less made by maintenance operations or trouble, while the environment conservation module in which the number of necessary operation steps is small at the time of connection or separation between the modules is disposed at the rear side of the image output module in which access is relatively often made by maintenance operations or trouble. Thus, the maintenance operations of the image output module or the access and operations at the time of trouble can be easily and effectively carried out. Besides, since connection to an external equipment is made through the electrical-related module, to provide it at an end is more effective in operation.

Further, in the first image forming apparatus including the three basic modules or the second image forming apparatus including the two additional modules in addition to the basic modules, it is desirable that the apparatus is constructed such that a space in which another module is not connected and arranged is formed at a rear side of the sheet discharge module. In this case, it is appropriate that a maintenance part requiring maintenance operations is provided in a neighborhood portion of the sheet discharge module or the sheet discharge module and the environment conservation module confronting the space, and an opening/closing door for maintenance operations is provided.

In the case where the apparatus is constructed to form such space, it becomes possible to use the space as an operation space for maintenance, exchange of parts, or the like. When the maintenance part is provided at the predetermined module portion confronting the space and the opening/closing door for the maintenance operations is provided, the inspection, exchange operations or the like of the maintenance part can be easily and effectively carried out.

Besides, in the first or second image forming apparatus, it is desirable to provide a height adjusting mechanism in the sheet supply module and the sheet discharge module.

In the case where such height adjusting mechanism is provided, it becomes possible to adjust the height of the sheet supply module and the sheet discharge module with the image output module as a standard, and it becomes possible to especially connect the sheet conveying routes between the respective modules after making them accurately coincident with each other.

Moreover, in the first or second image forming apparatus, it is desirable to provide a sheet guide member which can be opened and closed from a front side of the apparatus, at a connection portion between the sheet sending passage of the sheet supply module and the sheet conveying passage of the image output module, and at a connection portion between the sheet conveying passage of the image output module and the sheet discharge passage of the sheet discharge module.

In the case where such sheet guide member capable of being opened and closed is provided, even if sheet clogging occurs in the connection portion of the sheet conveying route between the respective modules, since the sheet conveying route can be opened through access from the front side of the apparatus, the clogged sheet can be easily removed.

Besides, in the first or second image forming apparatus, it is desirable that the apparatus is constructed such that an installation space for installation of an image reading module made of an independent structure provided with a reading unit to read an image of a document is provided at an upper portion of the sheet supply module, and in a case where the image reading module is not installed, a space filling casing to fill the space of the installation space is installed.

By providing such installation space and the space filling casing, in the case where the image forming apparatus is constructed as a copying machine, the image reading module can be effectively and neatly set on the upper portion of the sheet supply module, and in the case where the image forming apparatus is constructed as a printer, the empty installation space after removal of the image reading module is filled with the space filling casing so that the outer fine appearance can be held, and the upper surface of the casing can be used as a bench.

Moreover, in the first or second image forming apparatus, the image forming and transferring unit of the image output module includes, for example, plural image forming units, an intermediate transfer body unit provided at a lower side of the image forming units, and a secondary transfer unit provided at a lowest portion of the intermediate transfer body unit.

In the image output module including the image forming and transferring unit of such a structure, although the size of the module itself in the height direction is apt to become large, as described above, since the whole apparatus is divided into the basic modules and addition modules respectively in an effective unit and is constructed, the size of the image output module itself in the height direction can be easily suppressed.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

[Embodiment 1]

Figure 1:
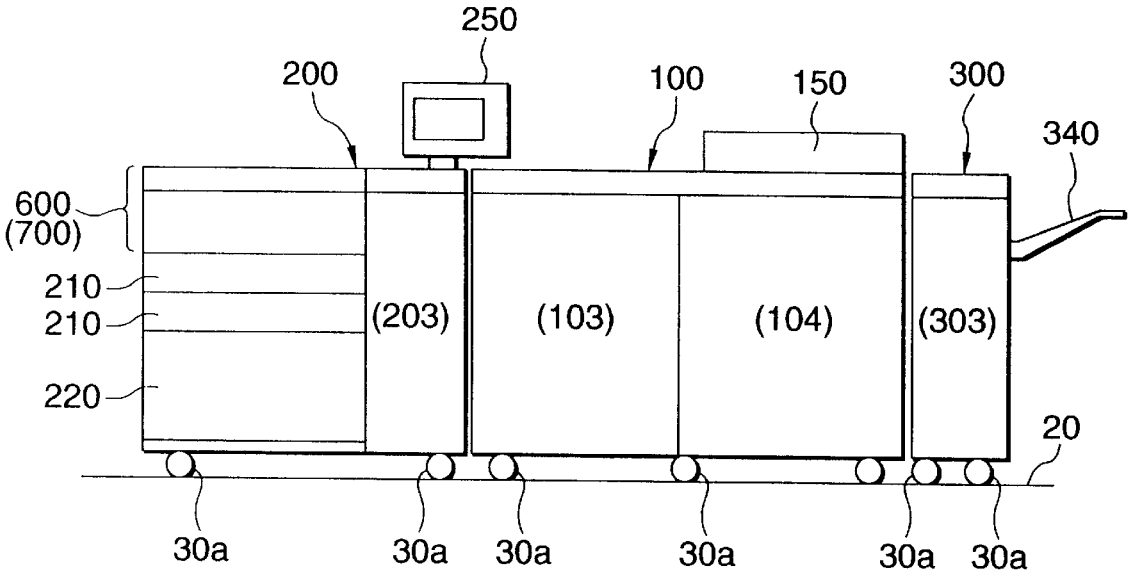
FIG. 1 is a front view of an external appearance showing an image forms apparatus of a first embodiment.
Figure 2:
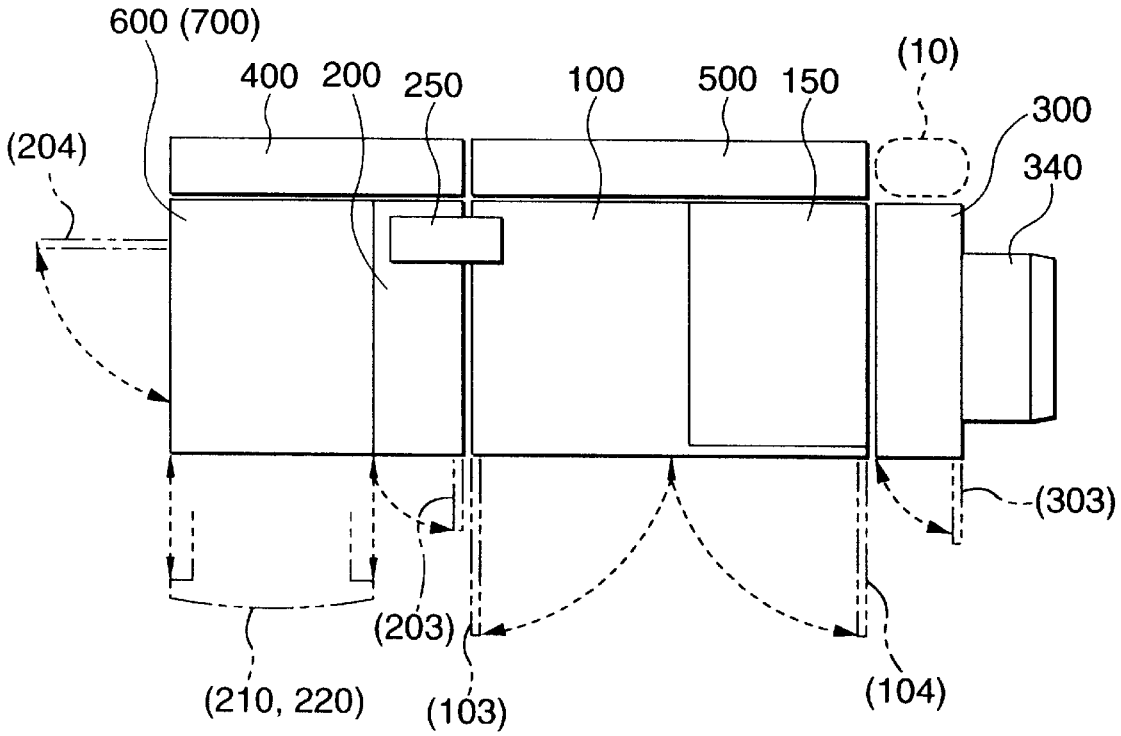
FIG. 2 is an external appearance top view showing the image forming apparatus of FIG. 1.
Figure 3:
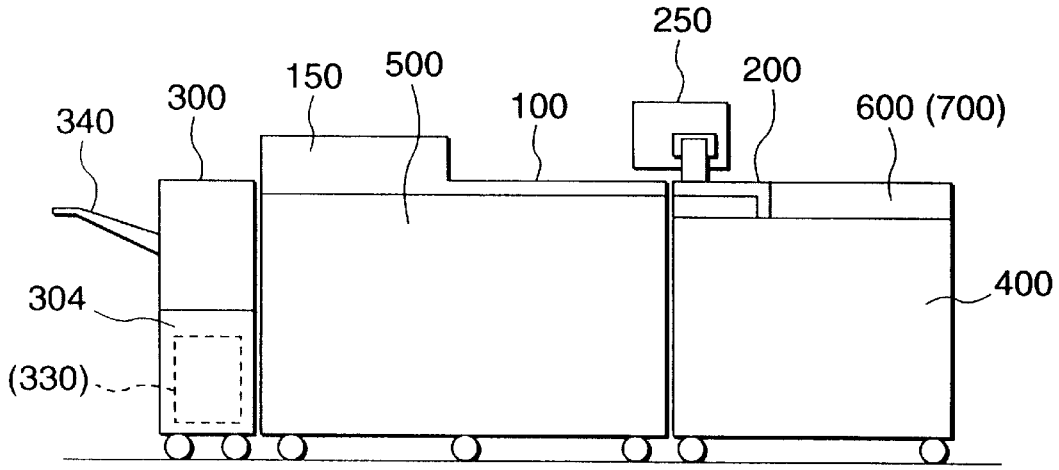
FIG. 3 an external appearance rear view showing the image forming apparatus of FIG. 1.
Figure 4:
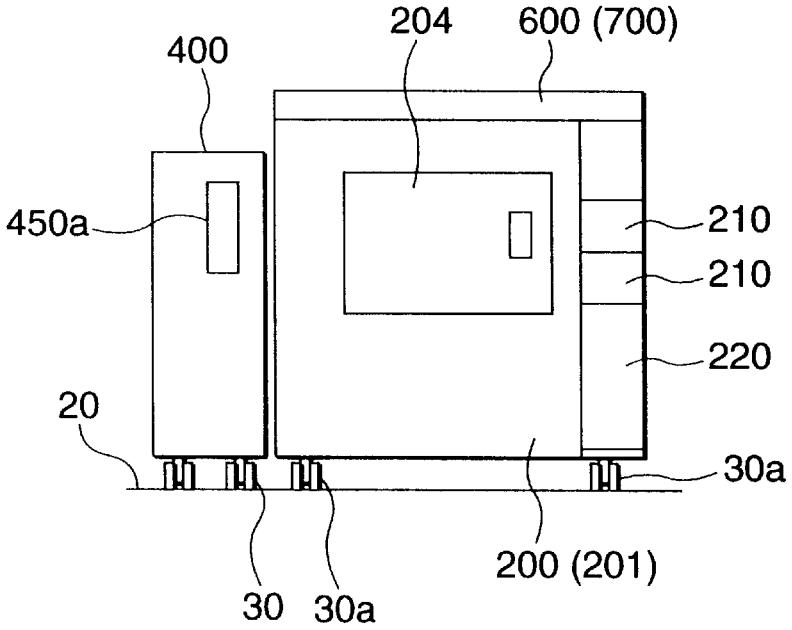
FIG. 4 is an external appearance left side view showing the image forming apparatus of FIG. 1.
Figure 5:
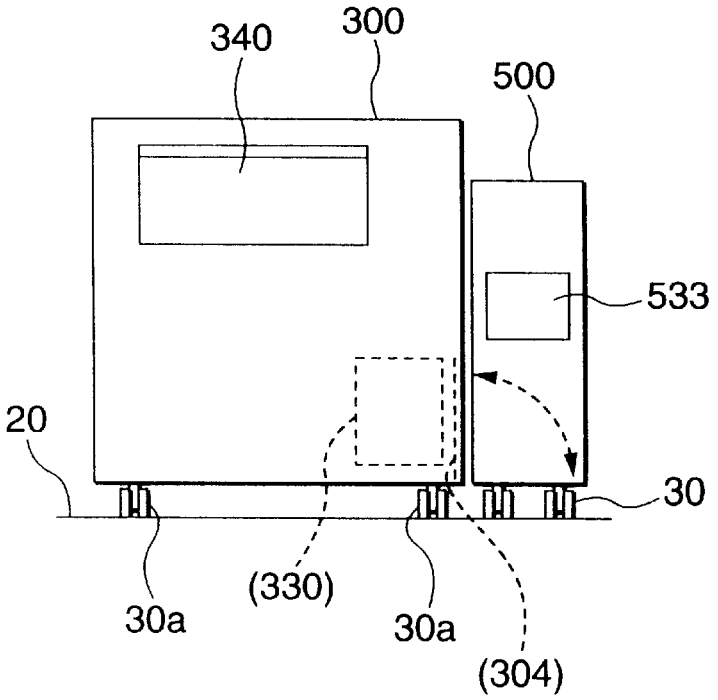
FIG. 5 is an external appearance right side view showing the image forming apparatus of FIG. 1.
Figure 6:
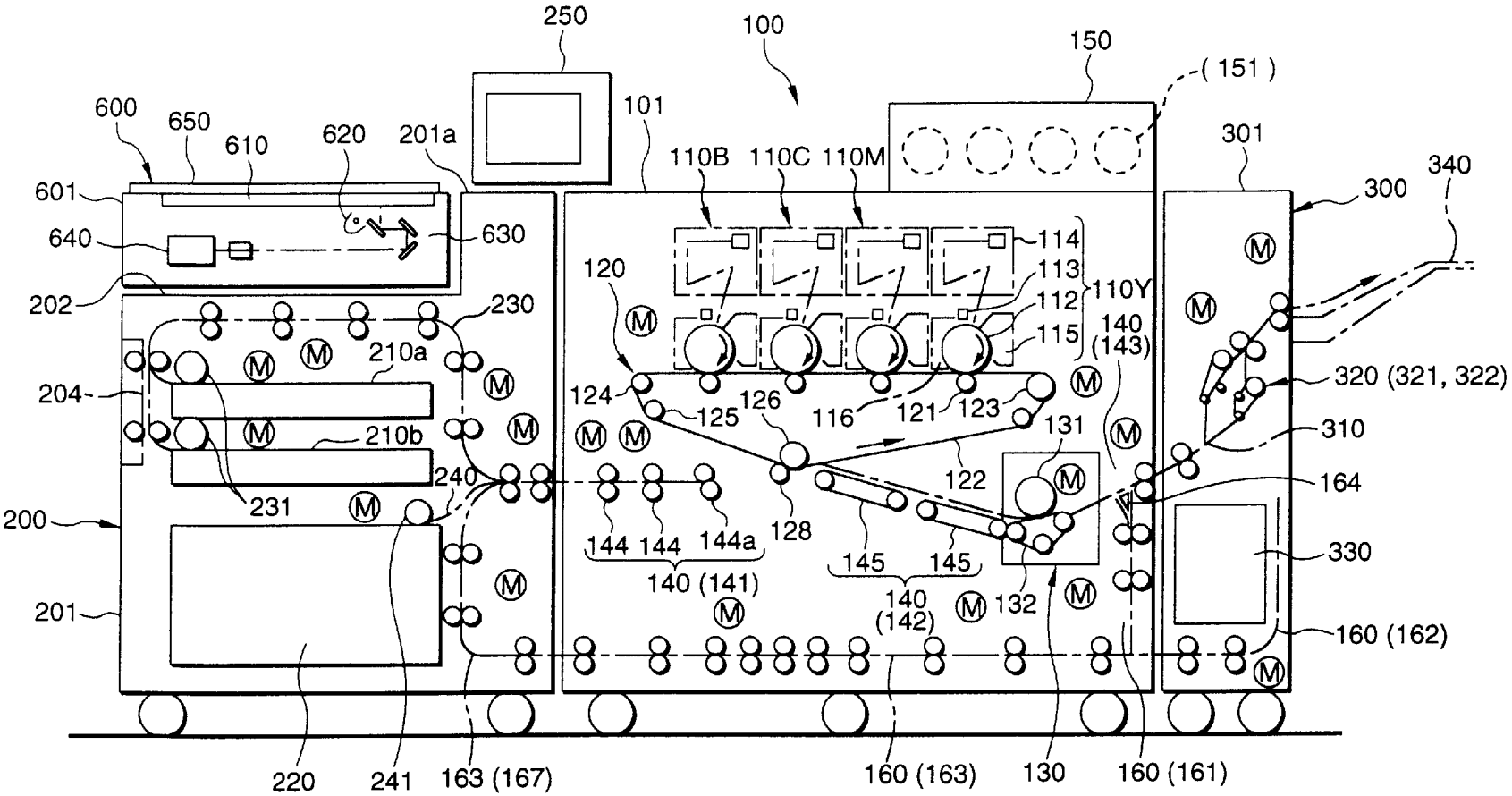
FIG. 6 is a schematic view, seen from a front side, showing an internal structure of the image forming apparatus (basic module) of FIG. 1.
Figure 7:
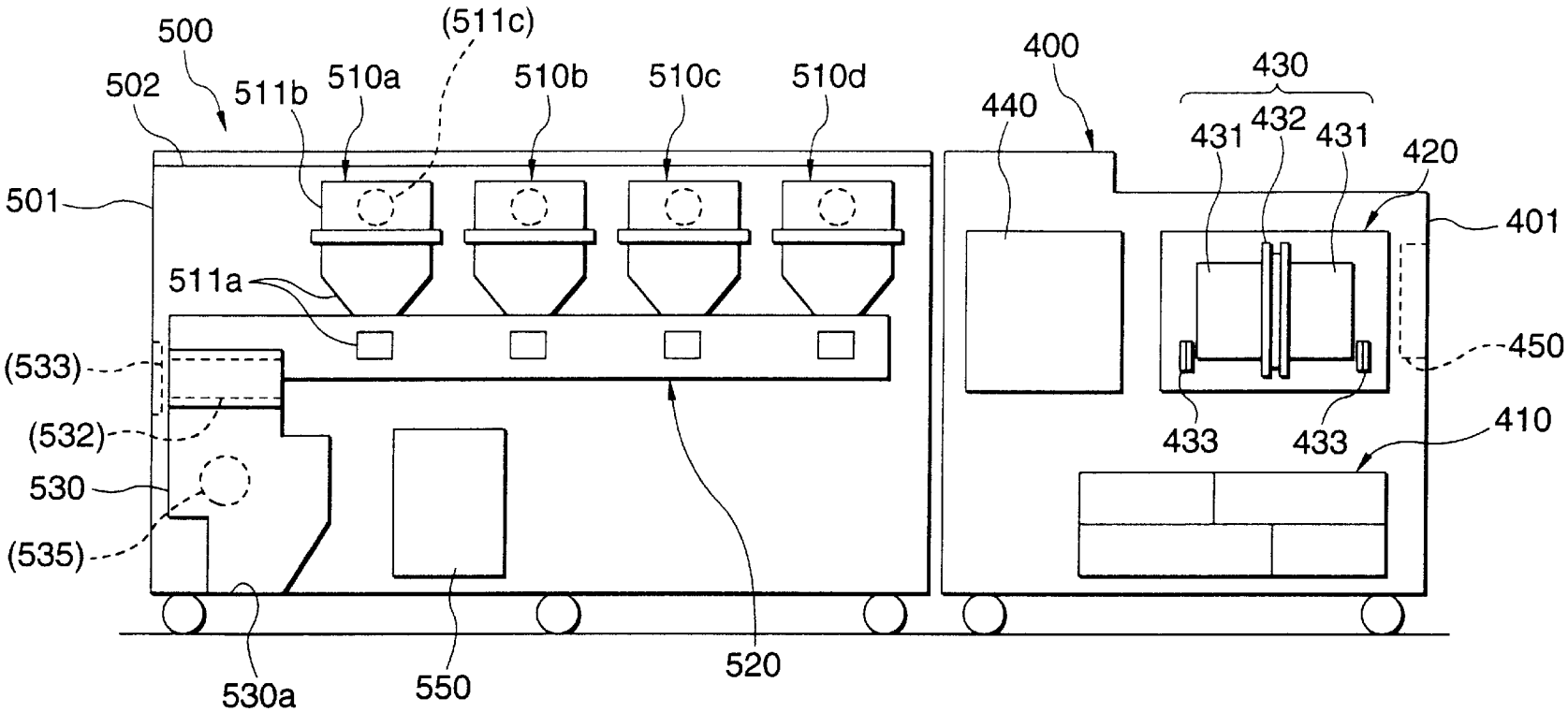
FIG. 7 is a schematic view, seen from a rear side, showing an internal structure of the image forming apparatus (additional module) of FIG. 1.

FIGS. 1 to 7 show a color image forming apparatus according to an embodiment of the present invention, in which FIG. 1 is a front view of its outer appearance, FIG. 2 is a top view of its outer appearance, FIG. 3 is a rear view of its outer appearance, FIG. 4 is a left side view of its outer appearance, FIG. 5 is a right side view of its outer appearance, FIG. 6 is an inside schematic view seen from its front side, and FIG. 7 is an inside schematic view seen from its rear side.

A main portion of this color image forming apparatus is constructed by basic modules made of three independent structures of an image output module 100, a sheet supply module 200, and a sheet discharge module 300, and addition modules made of two independent structures of an electrical-related module 400 and an environment conservation module 500. This image forming apparatus is used in such a state that the image output module 100 is positioned at the center, the sheet supply module 200 is connected and disposed at its left side, and the sheet discharge module 300 is connected and disposed at its right side, and further, the electrical-related module 400 made of the independent structure is connected and disposed at a rear side of the sheet supply module 200 in the basic modules thus connected and arranged, and the environment conservation module 500 made of the independent structure is connected and disposed at a rear side of the image output module 100. Incidentally, in this image forming apparatus, a space 10 where any other modules are not connected and arranged is formed at a rear side of the sheet discharge module 300. In the drawings, reference numeral 20 designates a floor surface, and 30 designates a caster attached to a bottom portion of each module.

Figure 8:
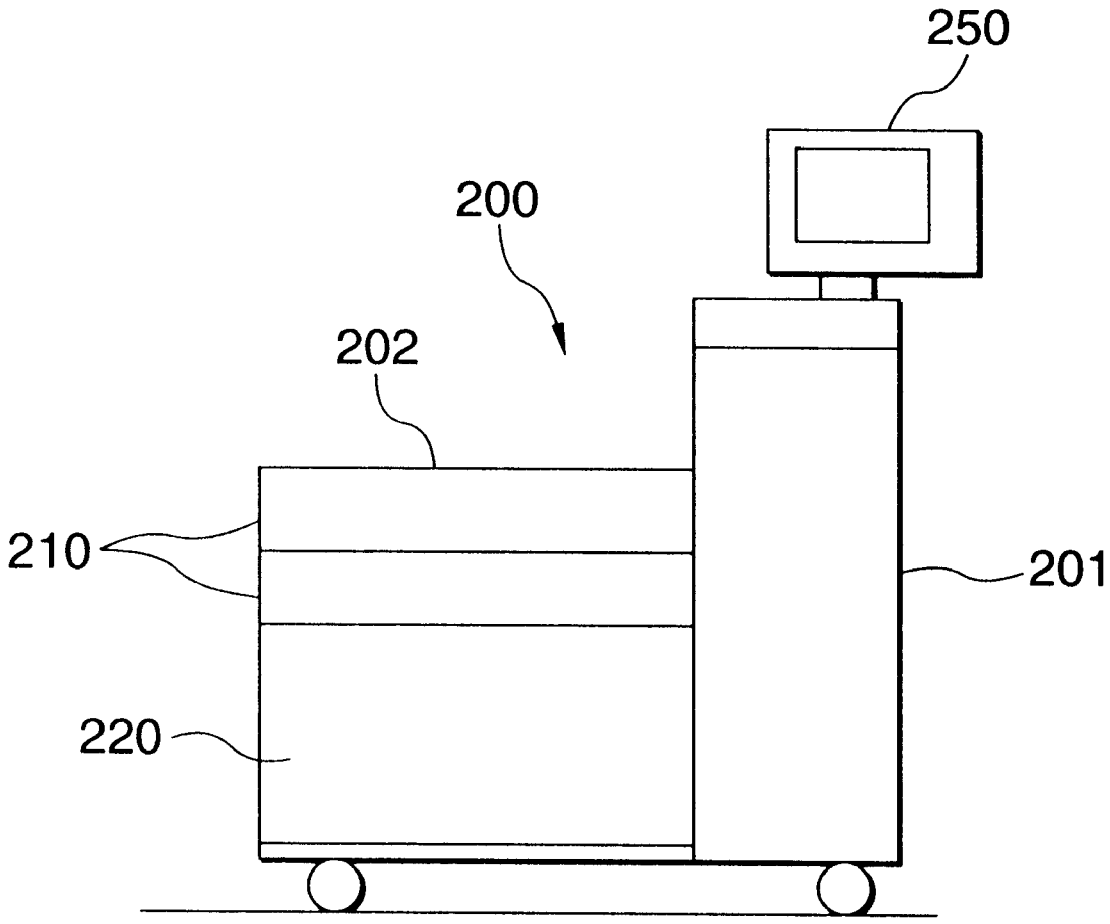
FIG. 8 is an outer appearance front view of a sheet supply module showing a form of an installation space.

In this color image forming apparatus, as shown in FIG. 8, an installation space 202 for installation of another module is provided at a left upper portion of the sheet supply module 200. In the case where the image forming apparatus is used as a copying machine, a document reading module 600 is installed in the installation space 202, and in the case where it is used as a printer, a cover 700 as a space filling casing is installed in the installation space 202.

The foregoing respective modules have structures as described below.

First, the image output module 100 includes, in its casing 101 (structural portion formed into a box shape with a support frame, outer panel, and the like. It is assumed that the same thing can be said of the following other casings), as an image forming and transferring unit to form a toner image corresponding to image information and to transfer it to a recording sheet P, four image forming units 110Y, 110M, 110C, and 110K for forming toner images of four colors of yellow (Y), magenta (M) cyan (C) and black (K) by an electrophotographic system, and an intermediate transfer unit 120 of a belt system which is arranged below the four image forming units 110Y, 110M, 110C, and 110K, transfers the toner image formed by the respective image forming units, and conveys it to a secondary transfer portion where it meets the recording sheet P. Besides, a thermal fixing unit 130 of a belt nip system as a fixing unit to fix the toner image transferred to the recording sheet P by the image forming and transferring unit is provided in the casing 101. Further, a sheet conveying passage 140 to convey the recording sheet P such that it passes through the image forming and transferring unit (in this embodiment, the secondary transfer portion of the intermediate transfer unit) and the fixing unit is provided.

The image forming units 110Y, 110M, 110C and 110K are provided in a parallel state with a constant interval along the horizontal direction in the inside of the casing 101. Any of them has the same structure, and is roughly constructed by a photoreceptor drum 112 as an image support rotating in an arrow direction at a predetermined speed, a screened corotron 113 as a charging unit to uniformly charge the surface of the photoreceptor drum 112, a ROS (Raster Output Scanner) 114 as an image exposure unit to form an electrostatic latent image by exposing a light image corresponding to image information onto the surface of the photoreceptor drum 112 charged by the screened corotron 113, a developing device 115 to develop the electrostatic latent image formed by the ROS 114 on the photoreceptor drum 112 by supplying toner of a predetermined color, and a cleaning device 116 to remove and recover untransferred toner remaining on the photoreceptor drum 112 after a transfer step.

In any of the ROSs 114 of these image forming units 110, a laser beam modulated in accordance with image information (gradation information for each color) is emitted from a semiconductor laser, the laser beam is deflected and scanned through a rotating polygon mirror and plural optical parts, and is scanned and exposed on the photoreceptor drum 112. The developing device 115 is a two-component developing device using a two-component developer made of a toner and a carrier. The two-component developer for each color is supplied through a not-shown developer supply device from a developer containing cartridge 151 of each color (Y, M, C, K) detachably attached in a developer box 150 protrudingly formed at an upper portion of the casing 101. The old used two-component developer (toner and carrier) in the respective developing devices 115 is made to overflow and is conveyed to a developer recovery box described later to be recovered (so-called trickle development is adopted). Further, a cleaning device 116 is constructed by a cleaning blade, a rotary blush or the like, and the recovered developer (toner) removed and recovered from the photoreceptor drum 112 is similarly recovered into the developer recovery box.

In the intermediate transfer unit 120, an intermediate transfer belt 122 to support and convey a toner (image) to be transferred is laid around a driving roll 123, a tension roll 124, a steering roll 125, a backup roll 126, and an idle roll at a constant tension in a shape where the whole forms an inverse triangle. Further, the intermediate transfer belt is arranged in a state where it comes in contact with (primary transfer portion of) the photoreceptor drum 112 in the respective image forming units 110 between the driving roll 123 and the tension roll 124, and is rotated in an arrow direction at a constant speed. A primary transfer roll 121 as a primary transfer device rotating to cause the belt 122 to come in contact with the drum 112 side is provided at a position where the intermediate transfer belt 122 confronts the photoreceptor drum 112 of the respective image forming units. A secondary transfer roll 128 as a secondary transfer device is provided at a position which becomes an opposite side of the backup roll 126 of the transfer belt 122.

The thermal fixing unit 130 is provided with a heating roll 131, and a nipping belt 132 which is laid around plural rolls in such a state that it comes in contact with a part of the heating roll 131 with a predetermined width and is freely rotated. A recording sheet P after secondary transfer is made to pass through a portion (belt nip portion) between the heating roll 131 and the nipping belt 132. Almost all the fixing unit 130 is covered with a heat insulating cover except for a sheet entrance and exit.

The sheet conveying passage 140 is constructed by a sheet supply passage 141 to convey the recording sheet P supplied from the sheet supply module 200 to the secondary transfer portion of the intermediate transfer unit 120, a sheet delivery passage 142 to convey the recording sheet P after transfer from the secondary transfer portion to the thermal fixing unit 130, and a sheet sending out passage 143 to send out the recording sheet P having passed through the thermal fixing unit 130 to the sheet discharge module 300. Among these, the sheet supply passage 141 is constructed by plural roll pairs 144 and plural sheet guide members 145 provided to intervene between the respective roll pairs 144 and to be opposite to each other with an interval in vertical direction (see FIG. 10). Among the roll pairs 144, a roll pair 144*a* immediately before the secondary transfer portion is a resist roll for sending out the recording sheet P to the secondary transfer portion at predetermined timing. The sheet delivery passage 142 is constructed by twin sheet suction conveying belt devices 145*a* and 145*b* for causing the recording sheet P after secondary transfer to be attached to the surface of the conveying belt by suction and transferring it. Further, the sheet sending out passage 143 is constructed by a roll pair 146 and a sheet guide member 147 (see FIG. 11).

In this embodiment, as the sheet conveying passage when double side image formation is made, a sheet double side conveying passage 160 is provided. This sheet double side conveying passage 160 is constructed by a sheet double side sending passage 161 to send out the recording sheet P after fixing to the double side conveying passage side, a sheet inverting passage 162 to invert the rear or front surface of the recording sheet P, and a sheet resending passage 163 to resend the recording sheet P after inversion to the side of the sheet supply passage. A conveying passage changeover pawl 164 to change a course of the sheet conveying passage is provided at a midway portion of the sheet sending out passage 143, and by this changeover operation of the conveying passage changeover pawl 164, the recording sheet P after fixing is conveyed to the side of the sheet double side sending passage 161. Any of the conveying passages 161, 162 and 163 constituting the sheet double side conveying passage 160 is constructed by plural conveying roll pairs 165 and sheet guide members 166 provided to intervene between the respective conveying roll pairs 165 and to be opposite to each other up and down or right and left (see FIGS. 6, 10 and 11).

Besides, at the front side of the casing 101 of the image output module 100, as shown in FIG. 2, two front doors 103 and 104 are attached to the right and left such that they can be opened and closed in the state as shown by arrows of dotted lines, and by opening of the front doors 103 and 104, maintenance operations of structural parts, such as the image forming unit 110, the intermediate transfer unit 120, or the sheet conveying passage 140, which are provided inside of the casing 101, removing operations of a clogged sheet, or the like can be easily made.

Next, in the casing 201 of the sheet supply module 200, two small capacity trays 210*a* and 210*b*, and one large capacity tray 220 are provided as the sheet accommodation unit to accommodate various (size, kind, etc.) recording sheets P used for image formation. Further, a first sending passage 230 for the small capacity tray and a second sending passage 240 for the large capacity tray are provided as the sheet sending passage to send out the recording sheet P accommodated in the respective trays 210 and 220 to the image output module 100. The upper right side of the casing 201 is set so that it coincides with the upper surface of the casing 101 of the image output module 100. A user interface 250 in which a display screen, an operation button, and a key for performing condition setting of image forming operation are provided is attached at the rear side of a casing upper plane 201*a*. Further, in this sheet supply module 200, a part of the sheet resending passage 163 in the sheet double side conveying passage 160 is provided at the right lower portion of the casing 201.

Any of the small capacity trays 210 and the large capacity tray 220 is structured such that it can be drawn out at the front side of the casing 201 (see FIG. 2), and it is possible to perform supply operations of the recording sheet P from the front side of the casing 201 to each tray. The first sending passage 230 is designed such that the recording sheet P accommodated in the respective trays 210*a* and 210*b* is sent out by a feed roll 231 provided at the tray left end side, and the sent out recording sheet P is conveyed to a sheet sending port by plural conveying roll pairs 232 and sheet guide members 233 in a route to cause the sheet to pass through an upper side of the casing 201. On the other hand, the second sending passage 240 is designed such that the recording sheet P accommodated in the large capacity tray 220 is sent out by a feed roll 241 provided at a tray right end side, and the sent out recording sheet P is made to meet the first sending passage 230 on the way (immediately before a conveying roll pair 232*a*) and is conveyed. A terminal passage 167 of the sheet resending passage 163 is designed such that the recording sheet P, which is inverted at the double side image formation and is resent, is made to meet the first sending passage on the way (immediately before the conveying roll pair 232*a*) and is again sent out to the image output module 100.

Figure 10A:
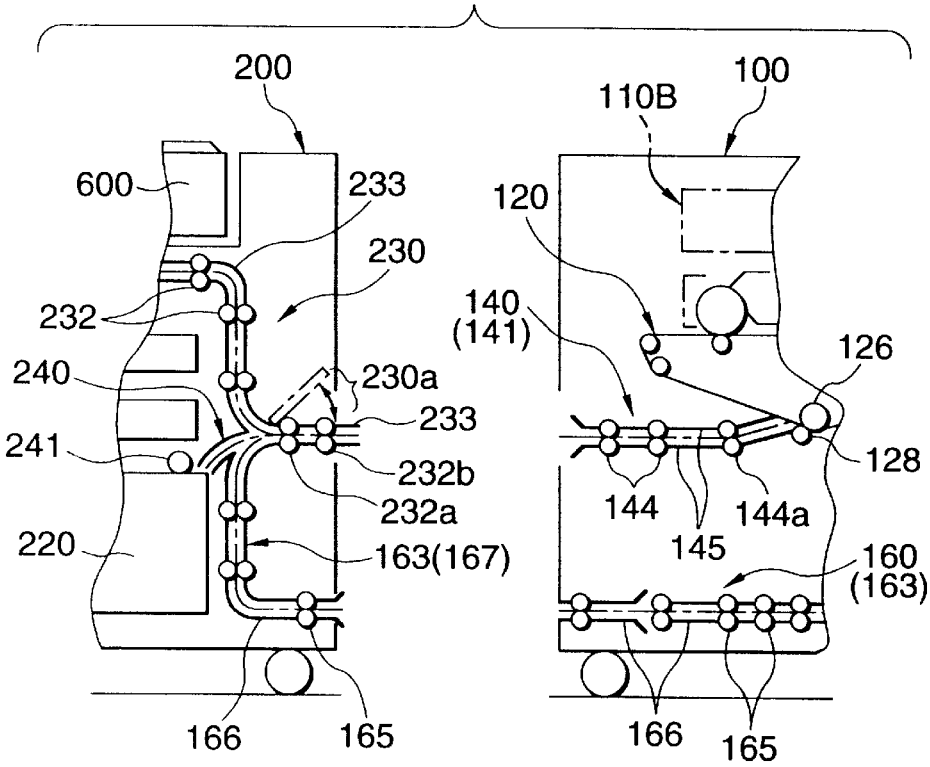
FIG. 10A is a main part schematic view, at the time of separation of both modules, showing each sheet conveying structure existing near a connection portion between a sheet supply module and an image output module.
Figure 10B:
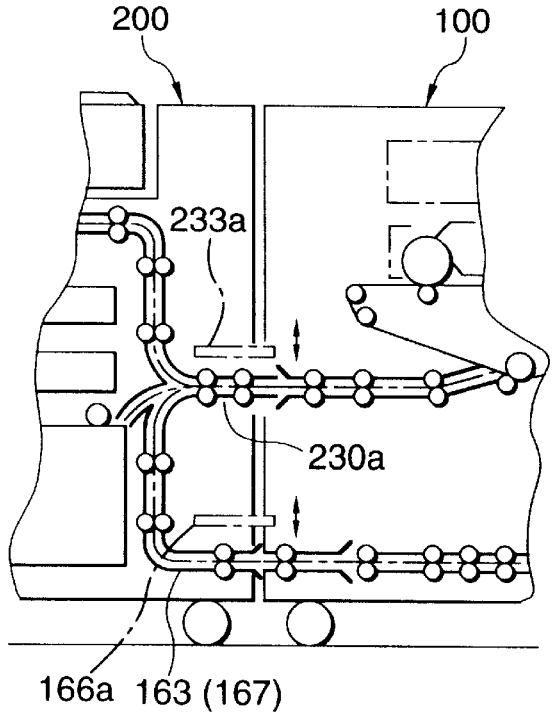
FIG. 10B is a main part schematic view at the time of connection of both the modules.

The sheet conveying passage in this sheet supply module 200 is structured such that as shown in FIGS. 10A and 10B, a terminal portion of the first conveying passage 230 (a downstream side from the conveying roll pair 232*a*, that is, the conveying roll pairs 232*a* and 232*b*, and the sheet guide member 233) 230*a* becomes horizontal at the time of module connection and protrudes from the side of the casing 201, and at the time of module nonconnection, it is swung around a fulcrum (hinge) located at the inside of the casing to be raised as one to the inner side of the casing and is housed. Further, the terminal portion 230*a* of the first conveying passage is designed such that in the case where sheet clogging occurs at the time of module connection, only an upper side sheet guide member 233*a* is swung around a fulcrum located at a rear side of the casing to be raised upward and the sheet conveying passage 230 can be made an open state (FIG. 10*b*). The sheet guide member 166 of the sheet resending passage 163 at the connection portion to the image output module 100 is in a state where it slightly protrudes from the casing 201 (FIG. 10*a*), and when sheet clogging occurs at the connection portion, only an upper side sheet guide member 166*a* is swung around a fulcrum located at a rear side of the casing to be raised upward, and the sheet conveying passage 163 can be made an open state (FIG. 10*b*).

Figure 9A:
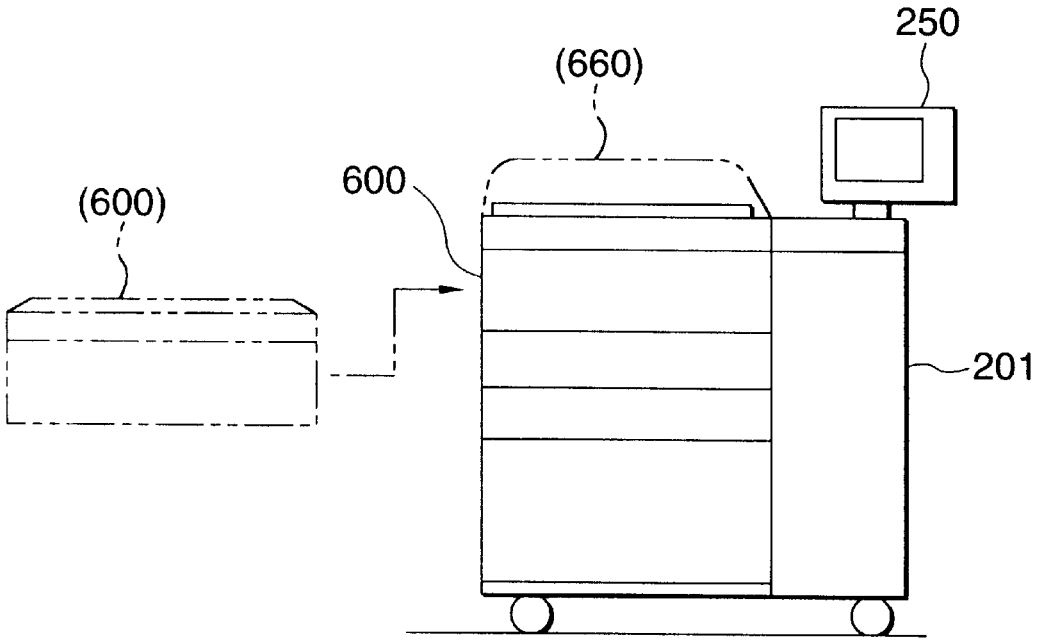
FIG. 9A is an outer appearance front view of the sheet supply module showing a state where a document reading module is installed in the installation space.
Figure 9B:
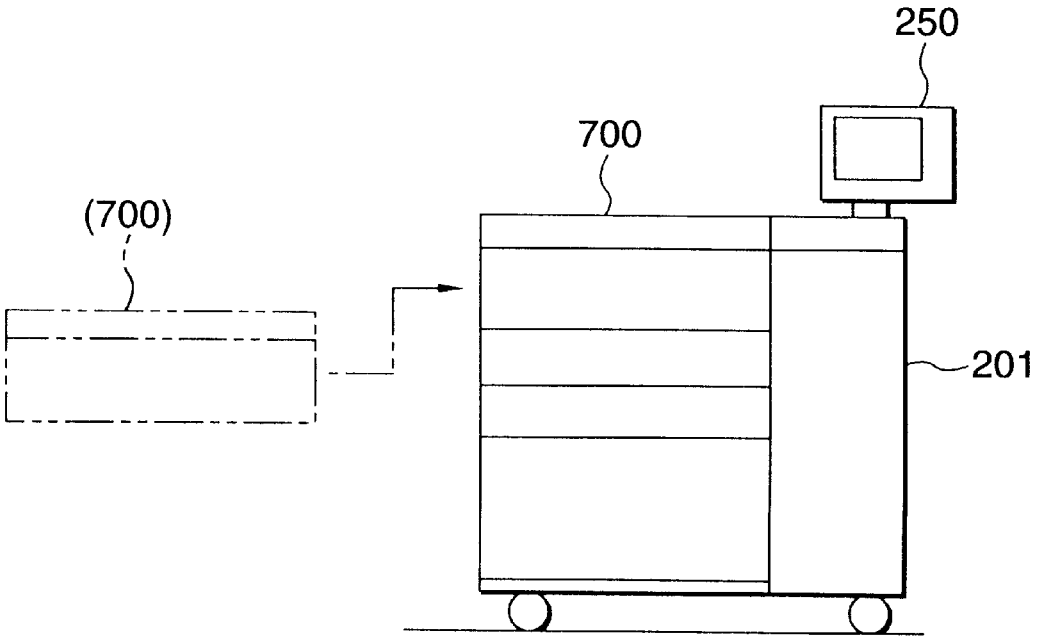
FIG. 9B is an outer appearance front view of the sheet supply module showing a state where a space filling cover is installed in the installation space.

Besides, in the sheet supply module 200, as described before, the installation space 202 having a shape recessed inward and downward is formed at the left upper portion of the casing 201, and the image reading module 600 or the cover 700 for filling the space is installed in the installation space 202. In FIG. 9*a*, reference numeral 660 designates a double side automatic document feeder (DADF) which automatically and sequentially conveys both the front and back sides of a document to a platen glass 610 of the image reading module 600 and can read images on both sides of the document.

Further, at the front right side of the casing 201 of the sheet supply module 200, as shown in FIG. 2, one front door 203 is attached such that it can be opened and closed in a state as indicated by an arrow of a dotted line. By opening of this front door 203, the maintenance operations of the respective sheet conveying passages 230, 240, and 163 provided in the casing 201 or removing operations of clogged sheet can be easily made. Besides, also at the left side portion of this casing 201, as shown in FIG. 2, one side door 204 is attached opposite to the first conveying passage 230 close to the sheet feed side of the small capacity tray 210 such that it can be opened and closed in a state as indicated by an arrow of a dotted line. By opening of this side door 204, the maintenance operations of part of the first conveying passage 230 provided in the casing 201 and removing operations of clogged sheet can be easily made.

As shown in FIG. 6, the image reading module 600 is provided with an image reading unit in which a not-shown document put on the platen glass 610 positioned at the upper portion of a casing 601 is irradiated by a light source 620, and a reflected light image from the document is projected onto an image reading element 640 made of CCDs or the like through a demagnification optical system 630 made of plural mirrors and imaging lenses. A color material reflected light image of the document is finally read by the image reading element 640 at predetermined dot density. In the drawing, reference numeral 650 designates a platen cover. The image information (signal) read out by this image reading unit is sent to an after-mentioned image processing device (IPS) provided in an after-mentioned electrical-related module 500. Besides, the space filling cover 700 installed in the installation space 202 instead of this image reading module 600 is constructed by a hollow casing having such an outer size as to be able to fill the space of the installation space 202, and its upper surface is formed of a flat surface having the same height as the right upper plane 201*a* of the casing 201 of the sheet supply module.

Next, as shown in FIG. 6, the sheet discharge module 300 is provided, in its casing 301, with a sheet discharge passage 310 to discharge the recording sheet P after fixing sent out from the image output module 100 to the outside of the apparatus. Besides, at a midway portion of the sheet discharge passage 310, a decurl mechanism 320 for eliminating curl produced in the recording sheet P is provided, and a developer recovery box 330 for recovering a used developer from the developing device 115 positioned at the side of the image output module 100 and a recovered developer from the cleaning device 116 is provided. Further, this sheet discharge module 300 is provided with the sheet inverting passage 162 in the sheet double side conveying passage 160 from the bottom of the casing 301 to the right side portion.

Figure 11A:
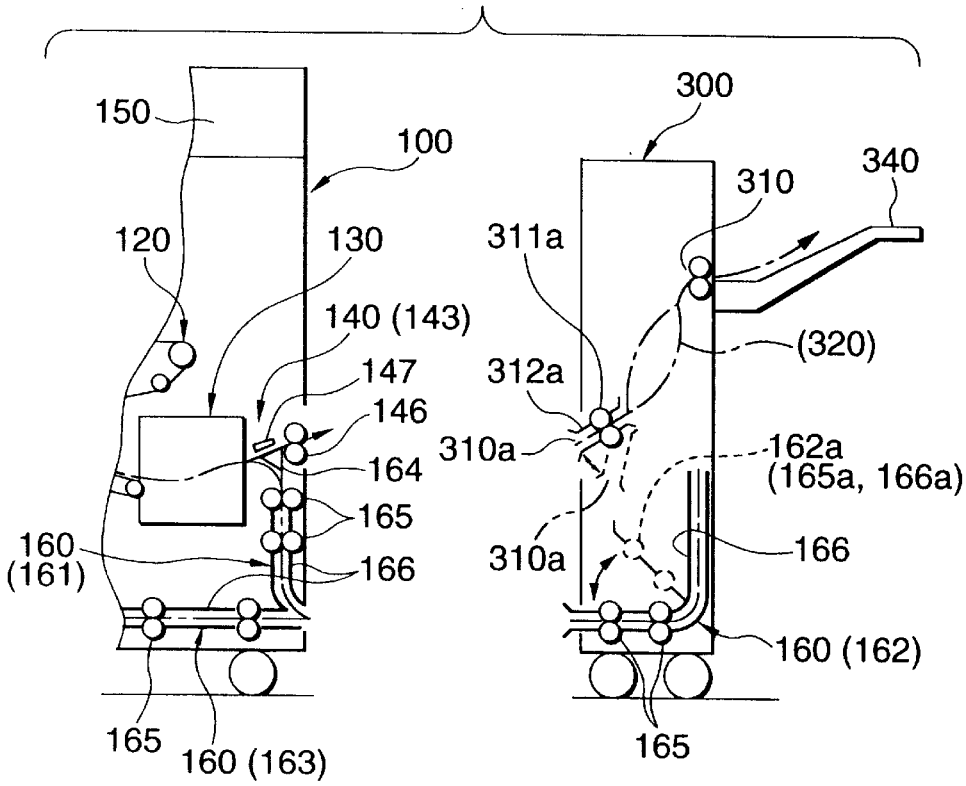
FIG. 11A is a main part schematic view, at the time of separation of both modules, showing each sheet conveying structure existing near a connection portion between an image output module and a sheet discharge module.
Figure 11B:
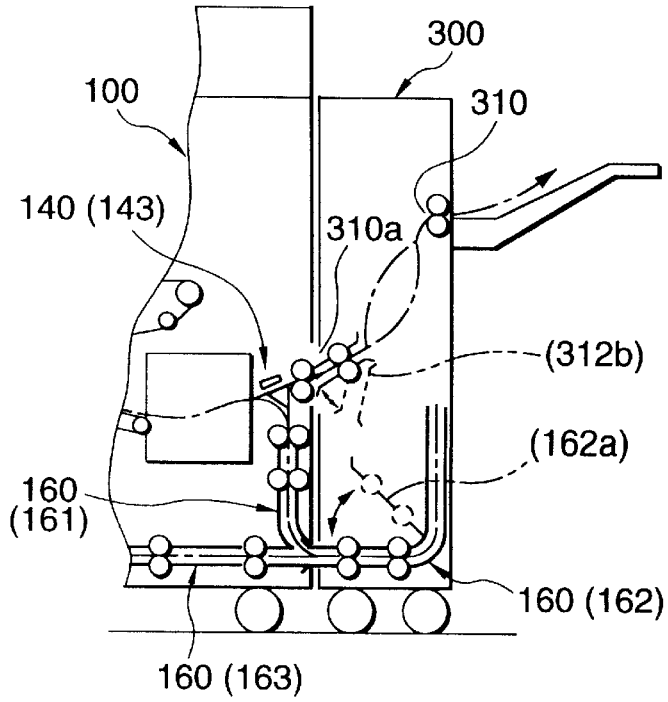
FIG. 11B is a main part schematic view at the time of connection of both the modules.

The sheet discharge passage 310 is constructed by plural conveying rolls 311 and sheet guide members 312 (see FIGS. 11A and 11B). The recording sheet P sent out by the final stage conveying roll is discharged onto a discharge tray 340 attached to the outside of the casing 301 so as to protrude and is stacked and accommodated. The decurl mechanism 320 is provided with two kinds (types different in direction to give a bending stress) of decurl conveying passages 321 and 322 constructed by suitably combining rolls and belts such that a bending stress in an opposite direction to a curl direction is given to the conveyed recording sheet P. The mechanism is used in such a manner that on the basis of, for example, information obtained by detecting image density of an image to be formed or environmental conditions (temperature, humidity), the direction of curl produced in the recording sheet after fixing is supposed, and the recording sheet is selectively sent to the decurl conveying passage 321 (322) at the side to give a bending stress to eliminate the curl (see FIG. 6). The developer recovery box 330 is structured such that it is connected to a not-shown developer recovery conveying pipe extending from the image output module 100.

With respect to the sheet conveying passage in the sheet discharge module 300, as shown in FIGS. 11A and 11B, a start portion (structural portion made of a conveying roll 311*a* and a sheet guide member 312*a*) 310*a* of the sheet discharge passage 310 is constructed such that it is put in a state where it protrudes from a side of the casing 301 left and obliquely downward at the time of module connection, and at the time of module non-connection, it is swung around a fulcrum (hinge) positioned at the inside of the casing to be retracted as one into the inside of the casing and is housed. Further, the start portion 310*a* of the sheet discharge passage 310 is designed such that in the case where sheet clogging occurs at the time of module connection, only a lower sheet guide member 312*b* is swung around the same fulcrum to hang down, so that the sheet discharge passage 310 can be put in an open state (FIG. 11*b*). An upper side start portion (structural portion made of an upper conveying roll 165 and an upper sheet guide member 166*a*) 162*a* of the sheet inverting passage 162 at a connection portion to the image output module 100 is put in a state where it slightly protrudes from the casing 301 (FIG. 11*a*). When sheet clogging occurs in the module connection portion, only the upper side start portion 162*a* is swung around a fulcrum positioned at the inside of the casing to be raised upward, so that the sheet inverting passage 162 can be put in an open state (FIG. 11*b*).

Further, at the front side of the casing 301 of the sheet discharge module 300, as shown in FIG. 2, one front door 303 is attached such that it can be opened and closed in a state as indicated by an arrow of a dotted line, and by opening of this front door 303, the maintenance operations of the sheet discharge passage 310,the decurl mechanism 320, and the sheet inverting passage 162 provided in the casing 301, or the removing operations of clogged sheet can be easily carried out. Besides, at the rear side of this casing 301, as shown in FIGS. 3 or 5, one rear panel 304 is attached such that it can be opened and closed in a state as indicated by an arrow of a dotted line, and by opening of this rear panel 304, the developer recovery box 330 can be easily taken out.

Next, with respect to the electrical-related module 400, as shown in FIG. 7, in its casing 401, a transformation distributor 410 for transforming power from an after-mentioned main power supply to a predetermined voltage and distributing it is provided as a power supply part. Further, a circuit substrate unit 430 in which plural various circuit substrates (circuit substrates for performing image processing such as shading correction, brightness/color space conversion, gamma correction, frame erasure, and color/movement edition) 431 constituting an image processing device 420 are inserted in a mother board 432, and a hard disk unit 440 are provided as electronic equipment. The circuit substrate unit 430 is supported by a slide guide rail 433, and is structured such that after a rear panel of the casing 401 is taken off, it can be taken out to the rear side. Besides, in the casing 401, an external input/output equipment 450 for receiving external image information from an external equipment through a communication line such as a network is provided as a part constituting the image processing device 420. This external input/output equipment 450 is designed such that a communication connection cable 50 is connected to a connection terminal which is attached to the side portion of the casing 401 so as to be exposed (see FIG. 13).

Figure 12:
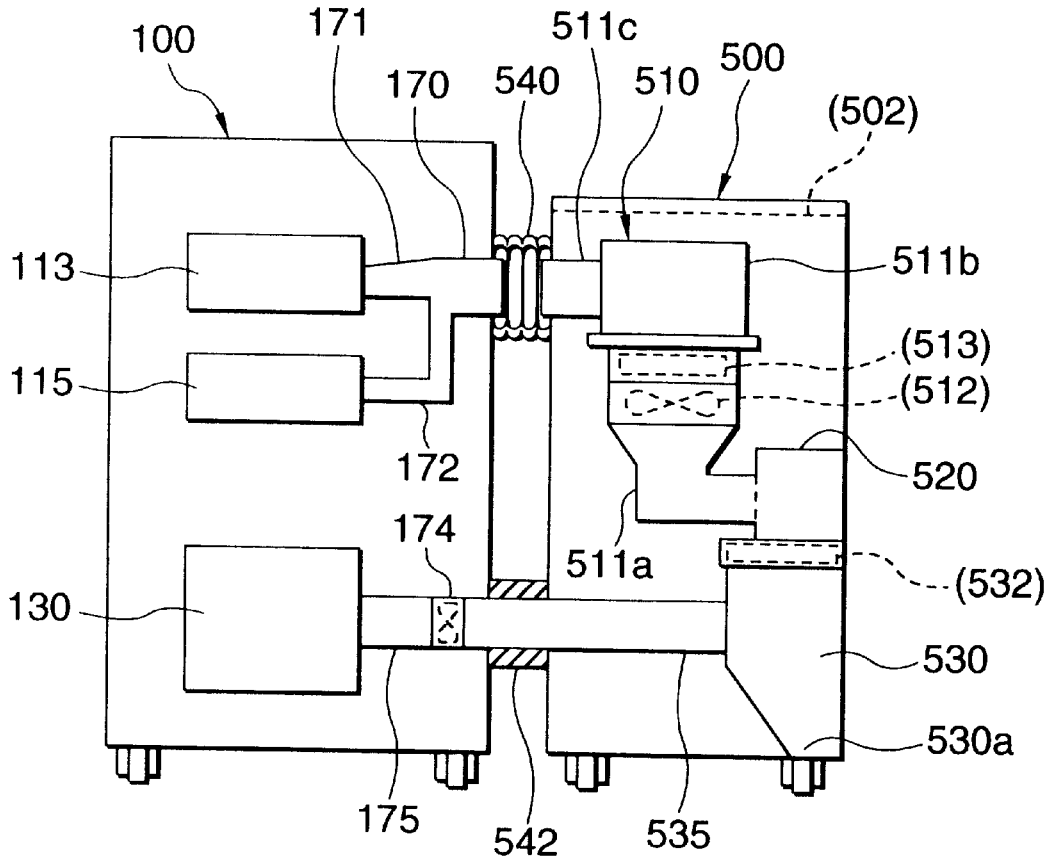
FIG. 12 is an explanatory view showing a providing state of ducts and a connection structure in an image output module and an environment conservation module.

Next, with respect to the environment conservation module 500, as shown in FIG. 7 or FIG. 12, in its casing 501, as a suction-collection unit to suck and collect an unnecessary substance (ozone, dust, hot air, etc.) produced mainly in the image output module 100, there are provided four suction-collection ducts 510*a* to 510*d* each having a built-in suction fan 512 and a filter 513, and a gathering duct 530 having a built-in filter 532 for collecting an exhaust discharged through the four suction-collection ducts 510*a* to 510*d* into a common duct 520 and for collecting the unnecessary substance remaining in the exhaust. Besides, in the casing 501, a main power supply 550 to receive electric power is provided in a free space where the suction-collection unit does not exist.

Any of the suction-collection ducts 510 has the built-in suction fan 512 and the filter 513, and is constructed by a duct main body 511*a* connected to the common duct 520, a duct cover 511*b* connected to the upper portion of the duct main body 511*a* to be able to open and close, and a connecting duct 511*c* connected from this duct cover 511*b* to a connecting duct 170 at the side of the image output module 100. The connecting duct 170 at the side of the image output module 100 branches off to two ducts 171 and 172. The one branch duct 171 is connected to the screened corotron 113 of the image forming unit 110, and the other branch duct 172 is connected to (vicinity of a development region of) the developing device 115. The connecting duct 511*c* is coupled with the connecting duct 170 at the side of the image output module 100 through a flexible pipe member 540. In the gathering duct 530, the exhaust discharged through the filter 532 is discharged from a discharge port 530*a* opened in the bottom of the device (casing 501). Further, a heat exhausting duct 535 for exhausting high heat generated in the thermal fixing unit 130 is connected to the gathering duct 530. The heat exhausting duct 535 is connected to a suction duct 175 having a built-in suction fan 174 and connected to the thermal fixing unit 130 at the side of the image output module 100. The connection between the heat exhausting duct 535 and the suction duct 175 is made through a connecting duct 542 which is subjected to heat insulation and sealing processing.

An upper surface of the casing 501 of this environment conservation module 500 is constructed as an upper cover 502 which can be taken off (FIG. 7, FIG. 12). By taking off this upper cover 502, the maintenance operations of the suction-collection duct 510 and exchange operations of the filter 513 can be easily carried out. At the right side surface of the casing 501, as shown in FIG. 5 or 7, an open/close panel 533 which can be taken off is provided. By taking off this open/close panel 533, the maintenance operations of the gathering duct 530 or exchange operations of the filter 532 can be easily carried out.

Figure 13:
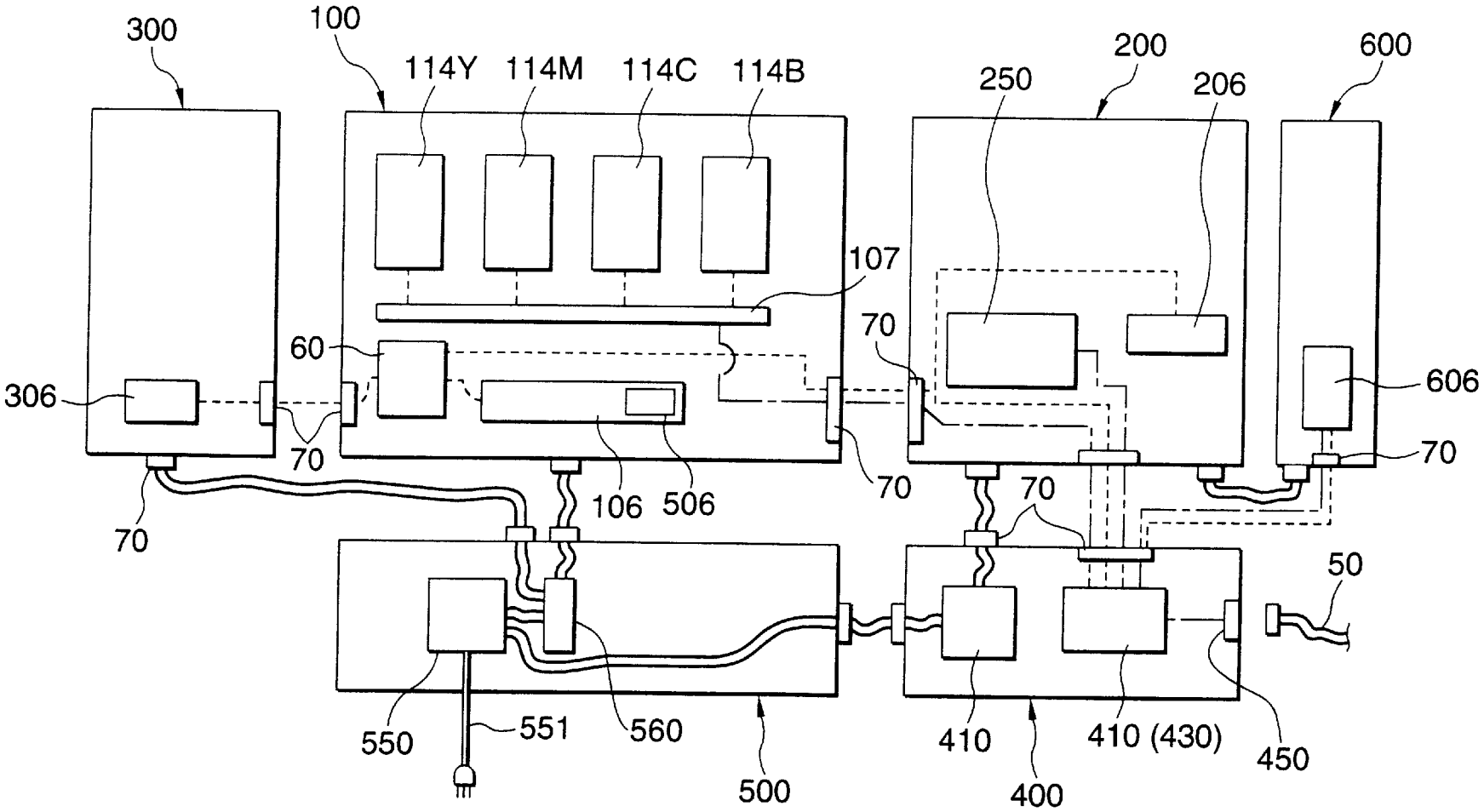
FIG. 13 is an explanatory view showing the structure of a power supply wiring system, an image signal wiring system, a control signal wiring system, and the like between the respective modules.

FIG. 13 is an explanatory view showing the structure of a power supply wiring system (solid line), an image signal wiring system (one-dot-chain line), a control signal wiring system (dotted line) and the like between the respective modules.

First, any wiring system is structured such that the respective modules are connected to each other by a predetermined connection line through a connector (a part indicated by a small rectangle in the drawing) 70. Wiring connection through this connector 70 is performed at the time of the connecting operation between the respective modules.

A driver unit to control the operation of each driving part is disposed in the respective modules (except for the environment conservation module). Specifically, a driver unit 106 for controlling a driving motor M of the image forming unit 110, the intermediate transfer unit 120, the sheet conveying passage 140, etc., the light emitting source, and the like is disposed in the image output module 100, a driver unit 206 for controlling a driving motor M of the sheet sending passages 230 and 240, and the like is disposed in the sheet supply module 200, a driver unit 306 for controlling a driving motor M of the sheet discharge passage 310, the decurl mechanism 320, and the like is disposed in the sheet discharge module 300, and a driver unit 606 for controlling a driving motor M of the document reading unit, the light emitting source, and the like is disposed in the document reading module 600. Incidentally, a driver unit 506 for controlling a driving motor M of the suction-collection unit 510 in the environment conservation module 500 is included in the driver unit 106 of the image output module 100. The respective driver units are connected to a central control controller 60 installed in the image output module 100 respectively through the wiring line (dotted line), and this central control controller 60 is connected also to a user interface 250.

In this image forming apparatus, since the image processing device 420 is provided in the electrical-related module 400, image information read by the document reading module 600 is transmitted to the electrical-related module 400 through the connection wiring line (one-dot-chain line), an image signal which was subjected to predetermined processing in the image processing device 420 is transmitted to the image output module 100 through the connection wiring line (one-dot-chain line), and the signal is taken into a signal processing unit 107 which performs signal processing to drive the four ROSs 114. External image information taken in from the external input/output equipment 450 is also transmitted to the image processing device 420 of the electrical-related module 400.

Further, when electric power (for example, 200 V) is inputted to the main power supply 550 provided in the environment conservation module 500 from an external socket through a power supply code 551, predetermined electric power is distributed from the main power supply 550 to the image output module 100 and the sheet discharge module 300 through a transformation distributor 560, respectively, and is distributed from the main power supply 550 to the electrical-related module 400. The electric power distributed to the electrical-related module 400 is distributed to the sheet supply module 200 and the document reading module 600 through the transformation distributor 410, respectively. By the electric power distributed in this way, the driving systems and driver units in the respective modules are operated.

Figure 14:
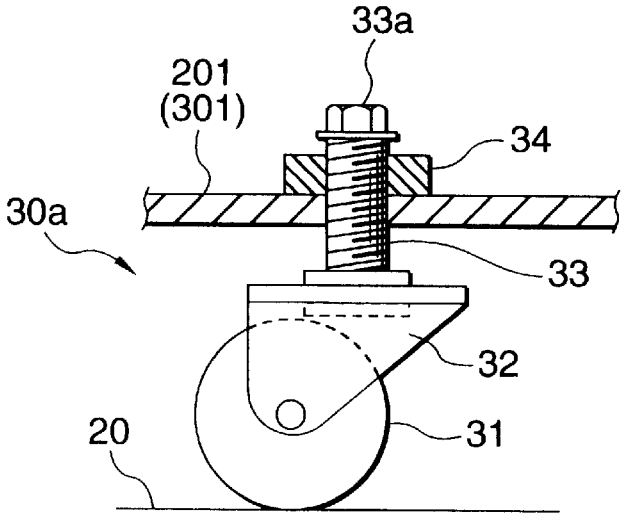
FIG. 14 is a partially sectional view showing the structure of caster with a height adjusting function.

FIG. 14 shows a caster 30*a* with a height adjusting a function as a height adjusting mechanism provided in the sheet supply module 200 and the sheet discharge module 300. This caster 30*a* with the height adjusting function has such a structure that a bolt-like prop 33 is attached to a bracket 32 for rotatably supporting a wheel 31. The bolt-like prop 33 is rotated by a predetermined amount (nut-like head 33*a*) to a caster attaching screw hole of respective casings 210 and 301 to adjust a position in the height direction, and a tightening nut 34 is finally tightened so that the height position of the bolt-like prop 33 is fixed. The bracket 32 has a structure rotatable to the bolt-like prop 33. By this caster 30*a* with the height adjusting function, it is possible to adjust the height of the sheet supply module 200 and the sheet discharge module 300 to coincide with the reference height of the image output module 100.

Figure 15:
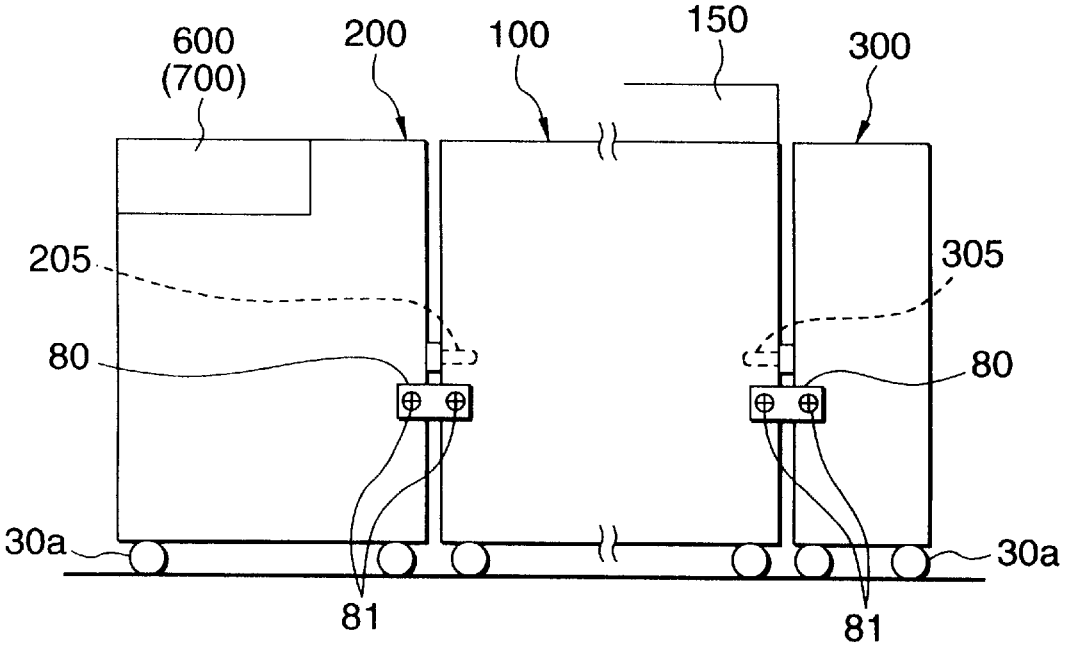
FIG. 15 is an explanatory view showing a coupling and fixing unit between basic modules.

FIG. 15 shows coupling and fixing units among the image output module 100, the sheet supply module 200, and the sheet discharge module 300 as the basic modules. In this embodiment, for the purpose of connecting the sheet supply module 200 and the sheet discharge module 300 to the image output module 100 at an accurate positional relation, positioning pins 205 and 305 for coupling are provided at the front side and the back side of the sheet supply module 200 and the discharge module 300 as connection surfaces to the image output module 100, respectively. On the other hand, pin holes in which the positioning pins 205 and 305 are correspondingly inserted are provided in the connection surfaces of the image output module 100 to both the modules. After the positioning pins are inserted in the pin holes, a coupling and fixing bracket 80 is used to fix the adjacent modules. The coupling and fixing bracket is screwed to the casing portion of the respective modules by a fixing screw 81 or the like so that they are fixed.

The respective modules made of the structure as described above are independently manufactured, and are independently packed and transported. They are connected and arranged to make the foregoing positional relation (FIGS. 1 to 3) at an installation place of an image forming apparatus and are united, so that they are completed and function as a final image forming apparatus.

Here, in the image forming apparatus constructed by the respective modules like this, since the respective modules are finely divided ones and any of them is a compact structure, the unit weight is divided to the respective modules and is made light. Besides, at the time of its transportation or movement, even if there is a narrow place such as an elevator or an entrance of a room, it becomes possible for the apparatus to pass through the place relatively easily. As a result, the work efficiency at the time of the transportation or movement is excellent.

Assembling of the image forming apparatus by connection and arrangement of the respective modules is performed through, for example, the procedure as follows:

First, the image output module 100 is put at an installation place, and its horizontal state is adjusted and the position is fixed. Subsequently, the sheet supply module 200 is connected and disposed at the left side of the image output module 100, and the sheet discharge module 300 is connected and disposed at the right side. At this time, after the wiring lines between the respective modules are connected through the connectors 70, the height of the sheet supply module 200 and the sheet discharge module 300 is adjusted by the caster 30*a* with the height adjusting function, so that the positioning pins 205 and 305 of the respective modules 200 and 300 are made to coincide with the pin holes of the image output module 100. After the height adjustment, the respective positioning pins 205 and 305 are inserted in the corresponding pin holes, and the sheet supply module 200 and the sheet discharge module 300 are connected to the image output module 100, respectively.

The respective positioning pins 205 and 305 are inserted in the corresponding pin holes, so that the sheet conveying routes between the respective modules become coincident with each and are connected. That is, the terminal portion 230*a* of the first conveying passage and the terminal portion 167 of the sheet resending passage at the side of the sheet supply module 200 accurately confront the start portion of the sheet supply passage 141 and the terminal portion of the sheet resending passage 163 at the side of the image output module 100, respectively, and they are coupled and connected. On the other hand, the start portion 310*a* of the sheet discharge passage and the sheet inverting passage 162 at the side of the sheet discharge module 300 accurately confront the sheet sending out passage 143 and the sheet double side sending passage 161 (sheet resending passage 163) at the side of the image output module 100, respectively, and they are coupled and connected. Besides, by insertion of the positioning pin in the pin hole, the height of the right upper portion of the sheet supply module 200 coincides with the upper surface portion of the image output module 100 and a continuous plane state is obtained.

After the insertion of the positioning pins is completed, the adjacent modules are fixed by using the coupling and fixing bracket 80 (FIG. 15). By this, the connection and arrangement among the three basic modules is completed.

Next, the electrical-related module 400 is connected and disposed at the rear side of the sheet supply module 200, and the environment conservation module 500 is connected and disposed at the rear side of the image output module 100. At this time, after the wiring lines between the respective modules are connected through the connectors 70, especially with respect to the environment conservation module 500, after the respective connecting ducts 511*c* of the suction-collection ducts 510*a* to 510*d* are connected to the connecting duct 170 at the side of the image output module 100 through the pipe member 540 (FIG. 12), fixing of the environment conservation module 500 at the time of connection is made by a screw having a dimension sufficient to connect both the modules. In the case where the document reading module 600 is used, after the document reading module 600 is installed at the installation space 202 of the sheet supply module 200, wiring lines between predetermined modules are connected through the connector 70.

In the manner described above, the respective modules are connected and arranged, so that the image forming apparatus of the positional relation as sown in FIGS. 1 to 3 (FIG. 9*a*) is assembled and is put in a usable state.

Next, an operation of forming a full color image by such an image forming apparatus (case of a copying machine) will be described.

First, a color document to be copied is set on the document reading module 600 (or the double side automatic document feeder 660), and its copy operation condition is set by operating the user interface 250. At this time, since the left upper surface of the image output module 100 and the right upper surface of the sheet supply module 200 are smooth surfaces, they can be used as a space where documents, papers, or the like are put and necessary operations are carried out.

A color material reflected light image of the document read by the document reading module 600 is sent, for example, as document reflectivity data of three colors of red (R), green (G) and blue (B), to the image processing device 420 in the electrical-related module 500, and the foregoing predetermined image processing is carried out in the image processing device 420. Next, the image information after the image processing is changed into four color (Y, M, C, B) document color material gradation data, and are outputted to the signal processing unit 107 in the image output module 100.

Subsequently, in the four image forming units 110Y, 110M, 110C, and 110K, in accordance with the document color material gradation data of the four colors, the respective ROSs 114 are operated, so that electrostatic latent images are formed on the respective photoreceptor drums 112, and then the respective electrostatic latent images are developed with a developer of a predetermined color by the respective developing units 115, and four color toner images are separately formed on the respective photoreceptor drums 112. After the four color toner images are primary transferred so as to be stacked onto the intermediate transfer belt 122 of the intermediate transfer unit 120 rotating to pass through the portion above the respective photoreceptor drums 112, they are conveyed to the secondary transfer position. At suitable timing to the formation of the toner images, a predetermined recording sheet P is supplied from the sheet supply module 100 to the secondary transfer position through the sheet conveying passage 230 (240) and the sheet supply passage 141.

When the recording sheet P is supplied to the secondary transfer position, the multiple toner images on the intermediate transfer belt 122 are secondary transferred to the recording sheet P, and then, the recording sheet P after the secondary transfer is sent to the thermal fixing unit 130 through the sheet delivery passage 142, and the toner image is thermally fixed. The recording sheet P after fixing is discharged to the outside of the apparatus through the sheet sending out passage 143 and the sheet discharge passage 310 of the sheet discharge module 300. By this, a full color image obtained by copying a (surface) image of the document is formed on (the surface of) the recording sheet P.

In the case where double side image formation is made, the recording sheet P on which single side image formation is ended is sent to the side of the sheet double side conveying passage 160 after fixing by the changeover operation of the conveying passage changeover pawl 164, and after the sheet surface is inverted by the sheet inverting passage 162, the sheet is again sent to the first conveying passage 230 and the sheet supply passage 141 through the sheet resending passage 163. After the toner image formed in the image forming unit 110 and corresponding to the rear surface of the document is transferred from the transferbelt 122 at the secondary transfer position, it is fixed in the same manner as the above, so that a full color image obtained by copying a rear surface image of the document is formed on the rear surface of the recording sheet P.

Further, in this image forming apparatus, in the period when the foregoing image forming operation is carried out, the following operation is executed.

That is, a used old two-component developer overflowed by the trickle development in the developing unit 115 and a recovered developer removed and recovered from the photoreceptor drum 112 after transfer by the cleaning device 116 are recovered in the developer recovery box 330 provided in the sheet discharge module 300 through the developer conveying pipe. By this, two kinds of developers which became unnecessary are together recovered in one recovery box.

Besides, the air surrounding the respective screened corotrons 113 in the image forming unit 110 is sucked by the duct 171, and toner (toner cloud) floating around the developing device 115 is sucked by the duct 172. Any sucked air is guided to the suction-collection duct 511 in the environment conservation module 500 through the ducts 170 and 511*c*, and ozone, dust (including toner) or the like contained in the air is collected by the filter 513. Next, the air having passed through the filter 513 is guided to the gathering duct 530 through the common duct 520, the dust or the like remaining in the air is collected by the filter 532, and finally, the air is exhausted to the outside of the apparatus through the exhaust port 530*a*. By this, an unnecessary substance (ozone, dust, hot air, etc.) produced in the apparatus is collected and exhausted, and the environment in the apparatus and outside the apparatus is conserved. On the other hand, at the same time as this, the high temperature air produced in the thermal fixing unit 130 is sucked by the suction duct 175, is guided to the gathering duct 530 through the connecting duct 542 and the heat exhausting duct 535, and finally, is exhausted to the outside of the apparatus through the exhaust port 530*a*. By this, an unnecessary rise of temperature in the apparatus can be suppressed, and also by this, the environment in the apparatus is conserved.

Besides, in this image forming apparatus, various operations such as maintenance operations can be carried out in the manner as described below.

For example, in the case where the developer recovery box 330 in the sheet discharge module 300 is inspected or exchanged, the rear panel 304 positioned at the rear of the casing 301 is opened to the space 10 side, so that the recovery box 330 in the casing 301 can be directly confirmed and can be taken out to the outside.

Besides, in the case where the suction-collection duct 510 in the environment conservation module 500 is inspected or a part is exchanged, the upper cover 502 as the upper plate of the casing 501 is taken off, so that the four suction-collection ducts 510 in the casing 501 can be directly confirmed, and by opening the duct cover 511*b*, the filter 512 in the inside can be exchanged. Further, in the case where the gathering duct 530 in the environment conservation module 500 is inspected or a part is exchanged, the open/close panel 533 at the side of the casing 501 is taken off from the space 10 side, so that especially the filter 532 in the duct 530 can be confirmed or exchanged.

In the respective operations, since the inspection or exchange operation of the developer recovery box 330 and the filter 532 of the gathering duct can be easily accessed from the space 10 formed at the rear side of the sheet discharge module 300, the space 10 is very useful in improvement of the operations.

Further, in the image output module 100 provided with the most structural parts, in the case where it becomes necessary to perform inspection or exchange from the rear side, the environment conservation module 500 connected and disposed at the rear side is detached from the image output module 100, so that the rear of the casing 101 appears and the operation becomes possible. At this time, for the separation of the environment conservation module 500, detachment of the connecting duct and detachment of several connection lines have only to be made. Thus, unlike the case where the electrical-related module 400 is connected and disposed at the rear side of the image output module 100, it is not necessary to perform troublesome detachment operations of the connection lines the number of which is relatively large, so that the operation becomes easy by that.

Besides, in this image forming apparatus, the conveying route of a recording sheet from the sheet supply module 200 to the image output module 100 and the sheet discharge module 300 does not become a complicated or abruptly bent route, but a relatively large number of portions are linear and even a bent portion is a gently curved route, so that noise or sheet clogging at the time of sheet conveying is hard to produce.

In the case where the sheet clogging occurs, the respective front doors in the respective modules are opened, so that all of the sheet conveying routes can be easily confirmed, and removal of clogged sheets can be easily performed. In the sheet clogging, especially sheet clogging occurs at the sheet conveying passage portion of the connection portion of the respective modules (actually, between the sheet supply module 200 and the image output module 100, and between the image output module 100 and the sheet discharge module 300), the removal of the sheet is troublesome. Thus, sheet conveying control is made so that the apparatus does not stop in the state where the recording sheet P strides across the portion between the respective modules.

This apparatus is structured such that in the case where sheet clogging occurs at the sheet conveying passage portion corresponding to the connection portion between the respective modules, the front door in the vicinity of the connection portion between the modules is opened, so that the respective sheet conveying passages can be easily confirmed or accessed from the front side of the apparatus.

Specifically, between the sheet supply module 200 and the image output module 100, when the front door 203 at the sheet supply module 200 side and the front door 103 at the image output module 100 side are opened (FIG. 2), as shown in FIG. 10*b*, the first conveying passage 230 and the sheet supply passage 141 or the sheet resending passage 163 and its terminal portion 167 can be confirmed or accessed from the front side of the apparatus. Besides, by lifting the upper sheet guide member 233*a* of the first conveying passage 230 or the sheet guide member 166*a* of the sheet resending passage terminal portion 167 to open the respective sheet conveying passages, the clogged sheet can be easily removed. On the other hand, between the image output module 100 and the sheet discharge module 300, when the front door 104 at the image output module 100 side and the front door 303 at the sheet discharge module 300 side are opened (FIG. 2), as shown in FIG. 11*b*, the sheet sending out passage 143 and the sheet discharge passage 310 or the sheet double side sending passage 161 and the sheet inverting passage 162 can be confirmed or accessed from the front side of the apparatus. Besides, by lifting the lower sheet guide member 312*b* of the sheet discharge passage 310 or the upper structural portion 162*a* of the sheet inverting passage to open the respective sheet conveying passages, the clogged sheet can be easily removed.

Further, in this image forming apparatus, as shown in FIG. 6, since the sheet conveying passages, driving parts such as the driving motor or suction fan, and the like are distributed to the respective modules and are dispersed, generation or resonance of conveying sound or operating sound in the casings of the respective modules can be suppressed and leakage of noise to the outside of the apparatus can be made small. Besides, since electronic equipment and the like being apt to generate an electromagnetic wave are together provided in the electrical-related module 400, such electromagnetic wave can be effectively suppressed in the module, and an influence of the electric wave on the image output module or the like can be suppressed. Further, in the image output module 100, in spite of the fact that the image forming and transferring unit includes the plural image forming units 110, the intermediate transfer unit 120, and the secondary transfer portion which are disposed in this order in the vertical direction, the height of the module in the height direction can be sufficiently suppressed.

Besides, by providing the sheet discharge module as the independent module, since the discharge passage for discharging the sheet after passing through the fixing unit of the image output module and in the sheet discharge module to the outside of the apparatus can be arranged obliquely upward from an upstream side to a downstream side, it is possible to make the layout of the image output module have the freedom, and the discharge tray 340 can be set through the conveying passage at the height such that the sheet can be easily taken. Moreover, since the main module is divided into three parts, the image output module can have plural sheet conveying passages 140 and 160 going in and out of the adjacent modules disposed left and right, and they can be provided in substantially the horizontal direction so that the sheet can be conveyed without stress.

It is also possible to arrange the developer recovery box by effectively using the space in the sheet discharge module except for the conveying passage. By doing so, it can be arranged at a terminal module, and handling such as exchange is also efficient.

Next, since the sheet conveying passages from the plural trays in the sheet supply module meet one conveying passage in the sheet supply module, it is possible to facilitate the control to the other adjacent image output module.

Further, the conveying passage 163 for double side printing, which returns from the image output module to the sheet supply module, is also made to meet that, so that they are joined into one in the sheet supply module, and it becomes possible to easily make control of sheets to the adjacent image output module.

Further, in the present invention, although the description has been made on toner as an image forming agent, the invention is not limited to this, but it can also be applied to image formation such as printing using ink or the like.

Besides, even if the image output module and the sheet discharge module are united to make an independent structure, it can be made according to the size of the image output module.

In addition, among the respective modules, even if serious trouble or the like occurs and repair is difficult or impossible, only the objective module can be exchanged, and in this case, an extra cost burden at the user side can be reduced.

[Another Embodiment]

In the embodiment 1, as the image output module, although a type in which a color image is formed is exemplified, a type in which a black and white image is formed may be used. Besides, as needed, a post-processing module for performing post-processing such as classifying and discharging of sheets (sorter function), stapling, punching, or bookbinding may be connected and disposed at the right side portion of the sheet discharge module 300.

As described above, according to the present invention, since the whole apparatus is constructed by plural modules made of extremely effectively divided independent structures, its handling at the time of transportation or movement becomes extremely convenient, it becomes possible to effectively suppress noise, sheet clogging, generation of electric wave noise, or the like, and the operationality of maintenance operations, part exchange operations, removing operations of clogged sheet, or the like is also improved.

What is claimed is:

1. An image forming apparatus comprising:

an image output module made of an independent structure including at least an image forming and transferring unit to form a toner image corresponding to image information and to transfer it to a recording sheet, a fixing unit to fix the toner image transferred to the recording sheet by the image forming and transferring unit, and a sheet conveying passage to convey the recording sheet to cause it to pass through the image forming and transferring unit and the fixing unit;

a sheet supply module made of an independent structure including at least a sheet accommodation unit to accommodate the recording sheet to be supplied to the image output module, and a sheet sending passage to send out the recording sheet accommodated in the sheet accommodation unit to the image output module; and a sheet discharge module made of an independent structure including at least a sheet discharge passage to convey the recording sheet after having passed through the fixing unit of the image output module and to discharge it to an outside of the apparatus, wherein the sheet supply module is connected and disposed at one of both sides of the image output module, the sheet discharge module is connected and disposed at the other, and the modules are used in an integrated state; and an electrical-related module made of an independent structure including at least a power supply part and an electronic equipment and being connected and disposed at a rear side of the sheet supply module, and an environment conservation module made of an independent structure including at least a suction-collection unit to suck and collect an unnecessary substance produced in the apparatus and being connected and disposed at a rear side of the image output module.

2. The image forming apparatus according to claim 1, wherein a space in which another module is not connected and arranged is formed at a rear side of the sheet discharge module.

3. The image forming apparatus according to claim 2, further comprising a maintenance part and an opening/closing door for maintenance operations in a neighborhood portion of the sheet discharge module or the sheet discharge module and the environment conservation module facing the space.

4. The image forming apparatus according to claim 1, wherein each of the sheet supply module and the sheet discharge module includes a height adjusting mechanism.

5. The image forming apparatus according to claim 1, further comprising a sheet guide member which can be opened and closed from a front side of the apparatus, at a connection portion between the sheet sending passage of the sheet supply module and the sheet conveying passage of the image output module, and at a connection portion between the sheet conveying passage of the image output module and the sheet discharge passage of the sheet discharge module.

6. The image forming apparatus according to claim 1, further comprising an installation space for installation of an image reading module made of an independent structure including a reading unit to read an image of a document, at an upper portion of the sheet supply module, and in a case where the image reading module is not installed, a space filling casing to fill the installation space.

7. The image forming apparatus according to claim 1, wherein the image forming and transferring unit of the image output module includes plural image forming units, an intermediate transfer unit provided at a lower side of the image forming units, and a secondary transfer unit provided at a lowest portion of the intermediate transfer unit.

8. The image forming apparatus according to claim 1, wherein the discharge passage in the sheet discharge module to discharge the sheet after having passed through the fixing unit of the image output module to the outside of the apparatus is arranged obliquely upward from an upstream side to a downstream side.

9. The image forming apparatus according to claim 1, wherein the image output module includes plural sheet conveying routes coming in and going out of the adjacent modules arranged right and left.

10. The image forming apparatus according to claim 9, wherein the plural sheet conveying routes in the image output module are provided in a substantially horizontal direction.

11. The image forming apparatus according to claim 1, wherein the sheet discharge module includes a developer recovery box.

12. The image forming apparatus according to claim 1, wherein sheet conveying passages from plural trays in the sheet supply module are joined into one conveying passage in the sheet supply module.

13. The image forming apparatus according to claim 9, wherein the plural sheet conveying routes are joined into one in the sheet supply module to convey the sheet to the downstream image output module.

14. The image forming apparatus according to claims 1, further comprising a document reading module disposed on the sheet supply module.

* * * * *